US007352290B2

(12) United States Patent
Eskridge

(10) Patent No.: US 7,352,290 B2
(45) Date of Patent: Apr. 1, 2008

(54) AWARE PATROL VEHICLE

(76) Inventor: Gregory S. Eskridge, 8010 Windward Beach Dr., Linden, MI (US) 48451

( * ) Notice: Subject to any disclaimer, the term of this patent is extended or adjusted under 35 U.S.C. 154(b) by 0 days.

(21) Appl. No.: 10/065,001

(22) Filed: Sep. 9, 2002

(65) Prior Publication Data

US 2004/0046646 A1 Mar. 11, 2004

(51) Int. Cl.
*G08G 1/09* (2006.01)

(52) U.S. Cl. ..... 340/905; 340/928; 340/572.1

(58) Field of Classification Search ..... 340/904, 340/905, 928, 933, 937, 10.1, 425.5, 426, 340/572.1; 701/9, 10, 35, 213, 301; 342/457
See application file for complete search history.

(56) References Cited

U.S. PATENT DOCUMENTS 5,973,643 A * 10/1999 Hawkes et al. ..... 342/457
6,052,068 A * 4/2000 Price R-W et al. ..... 340/933
6,222,463 B1 * 4/2001 Rai ..... 340/928
6,408,232 B1 * 6/2002 Cannon et al. ..... 340/933
6,525,672 B2 * 2/2003 Chainer et al. ..... 340/904
6,738,697 B2 * 5/2004 Breed ..... 701/29
6,861,959 B1 * 3/2005 Torres Sabate et al. ..... 340/944
6,958,707 B1 * 10/2005 Siegel ..... 340/902

* cited by examiner

*Primary Examiner*—Van T. Trieu
(74) *Attorney, Agent, or Firm*—Michael L. Greenberg, Esq.; Greenberg & Lieberman, LLC

(57) ABSTRACT

The present invention is a system installed in patrol vehicles such as highway patrol, or local police patrol. The system uses wireless technologies to scan and compare VIN (vehicle identification numbers) with license plate against the Department of Motor Vehicles database, and against the local police database for outstanding warrants. All passing cars would be processed. The system then displays the information on the patrol car''s computer system, and notifies the police officer of any outstanding warrants, if the car is stolen, and if there is a problem with the registration or tags on the vehicle.

16 Claims, 4 Drawing Sheets

Radio Frequency Tag Components

AWARE PATROL VEHICLE

BACKGROUND OF INVENTION

The present invention is a method for officers to automatically check passing vehicles to determine if the car is registered to a wanted criminal, or if the vehicleregistration is expired or invalid.

Often a Highway Patrol Officer or local Police Officer will pull a vehicle over for suspicious driving techniques, or vehicle violations. When an officer approaches a stopped vehicle the more information they have about the registered owner(s) of the car. For example, a driver may have out standing warrants for their arrest on various charges. The officers can put themselves in jeopardy without knowing it if they are approaching a car belonging to a wanted criminal. Likewise states have registries for convicted sex offenders. These registries are in place to protect citizens from repeat offenses. A link from these databases to data such as a license plate number would help officers in knowing whom they were dealing with before pulling the car over.

U.S. Pat. No. 4,660,528 issued to Buck on Apr. 28, 1987 shows an Apparatus for remote termination of the operation of a selected motor vehicle. Buck''s invention is unlike the present invention because it is intended to stop a vehicle by use of a RF transmitter. It does not supply highway patrol with a means to track individuals with outstanding warrants, registered sex offenders, and to track vehicle citations.

U. S. Pat. No. 5,764,138 issued to Lowe on Jun. 9, 1998 shows a RF identification system for providing static data and one bit of variable data representative of an external stimulus. U.S. Pat. No. 5,673,018 issued to Lowe, et al. on Sept. 30, 1997 shows a Transponder system for responding the distance traveled by a wheeled vehicle. Lowe''s invention is unlike the present invention because it is intended to relay tire pressure information to a control panel to alert a driver if tire pressure is low. Lowe et al.''s invention is unlike the present invention because it relays driving distance information by a relay at the tires. Neither of these inventions provides a means of connecting a car to an external database so that passing police officers have additional information on the registered owner of that vehicle.

U.S. Pat. No. 6,049,745 issued to Douglas on Apr. 11, 2000 shows a Navigation system for automatic guided vehicle. Douglas'' invention is unlike the present invention because it does not provide a means for police officers to scan passing and parked cars for vehicles registered to wanted criminal, or registered sex offenders. The system also does not offer police officers a system of monitoring commercial vehicles.

U.S. Pat. No. 6,163,278 issued to Janman on Dec. 19, 2000 shows an Electronic locating system for locating vehicles at assembly plants. Janman''s invention is unlike the present invention because it is a searching system using a particular VIN (Vehicle Identification Number) and a transmitter based on a lamp post or other structure in a parking lot, and a receiver in each car on the lot. It does not provide a means for highway patrol to scan any moving car, or parked car, and requires the car owner to voluntarily register the vehicle and install a scanner receiver in their car.

U.S. Pat. No. 6,236,911 issued to Kruger on May 22, 2001 shows a Load monitoring system and method utilizing transponder tags. Kruger''s invention is unlike the present invention because it is intended to double check loads on freight transferring vehicles such as tractor trailers. Kruger''s invention does not provide a means of connecting the system to a police database of vehicle violations or wanted criminals.

U.S. Pat. No. 6,366,220 issued to Elliott on Apr. 2, 2002 shows a RF tag based system and method for drive-through applications. U.S. Pat. No. 5,737,710 issued to Anthonyson on Apr. 7, 1998 shows an Automated vehicle parking system for a plurality of remote parking facilities. Elliott''s invention is unlike the present invention because it shows a method of having a RF transmitter attached to vehicle and linked to a credit card to ease payment through drive through locations Anthonyson''s invention uses the same technology to bill cars and manages accounts for long term parking facilities. Neither of these inventions provide a means for highway patrol officers to determine if a vehicle belongs to a wanted criminal, a registered sex offender o\r if the vehicle''s registration or tag is not correct or up to date.

Therefore a need has been established for storing commercial and passenger vehicle''s VIN, plate and registration information in an RF Tag or similar passive data storage device mounted or embedded within commercial or passenger vehicles.

SUMMARY OF INVENTION

The present invention addresses two problems faced by law enforcement officers.

The first problem addressed is: Which vehicles should be stopped based upon factual information like expired license plate or registration information that may not be humanly possible to observe from a vehicle passing a standing patrol vehicle at highway speeds.

The second problem addressed is: Once in police custody, are people who they say they are based on indisputable information i.e. fingerprint identification. The objective is to apprehend suspects using fake identification to avoid revealing their true identity or criminal history.

The present invention is a system installed in patrol vehicles such as highway patrol, or local police patrol. The system uses wireless technologies to scan and compare VIN (vehicle identification numbers) with license plate against the Department of Motor Vehicles database, and against the local police database for outstanding warrants. All passing cars would be processed. The system then displays the information on the patrol car''s computer system, and notifies the police officer of any outstanding warrants, if the car is stolen, and if there is a problem with the registration or tags on the vehicle.

The system will automatically monitor all commercial vehicles, any vehicles registered to repeat offenders, and registered vehicles to sex offenders. The system can also be programmed to monitor probable cause vehicles, pre-registered vehicles whose owners want additional security for the vehicle, moderate risk drivers and other police vehicles at the discretion of the user. The system will work with the existent vehicle databases in that police district, including stolen vehicle lists.

The system increases officer safety by giving the patrolling officer as much information as possible when pulling a vehicle over. It also improves officer''s efficiency, perhaps apprehending suspects who have been out of the grasp of local authorities based on false driver license or passport identification The system is not limited to scanning vehicles that are stolen, as is the present scanning system. It improves the efficiency of current databases and adds information to those databases by collecting and analyzing fingerprints of suspects. The system can also potentially reduce auto insurance rates by vehicle owners registering their vehicles voluntarily for the database. Each of the above items is monitored by use of an electronic tag in the automobile.

Subsequently, the information stored on the vehicle''s Electronic Tag can be read by specially equipped patrol vehicles capable of electronically scanning and comparing the VIN, license plate and registration information to locally stored (in patrol vehicle) or remotely stored (Department of Motor Vehicle or State, Federal or Local Law Enforcement databases. Furthermore, the system has extended capability to biometrically capture, transmit, analyze and confirm the individual identities of suspects via fingerprint submission. The remote device that the officer uses to capture fingerprints is a specially equipped handheld PDA configured with a fingerprint sensor, biometric capture software and short-range wireless hardware and software. The PDA device communicates with the patrol vehicle laptop by sending and receiving fingerprint information about the suspect. The officer also has the ability to do fingerprint collection and analysis via the in-vehicle laptop computer equipped with a USB version of the remote fingerprint collection sensor and collection software.

DETAILED DESCRIPTION

Figure 1:
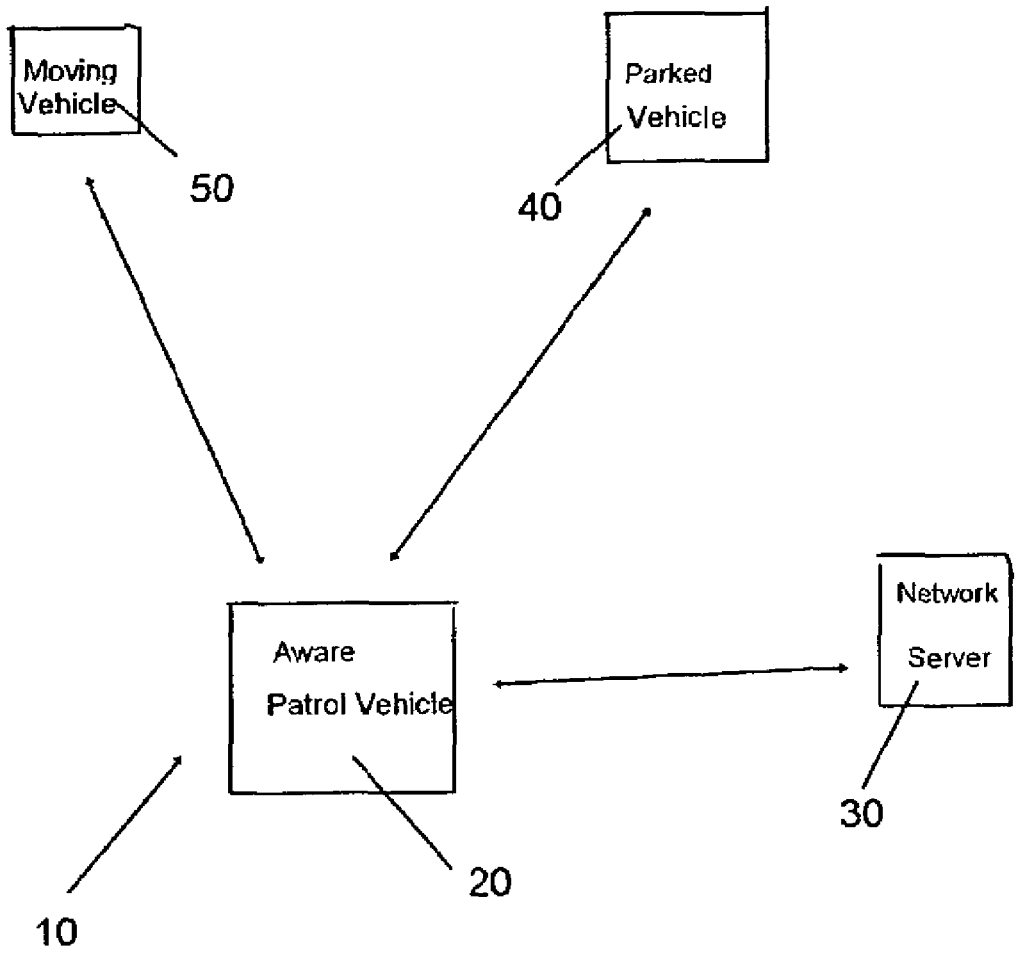
FIG. 1 shows a flow chart of the passing of information between the patrol car, the vehicles and the network server.

The present invention is a system installed in a patrol car, which can read tags located on a license plate, or in a vehicle. The aware vehicle system allows the patrol vehicle to alert the officer(s) of possible dangers such as a vehicle registered to a person with outstanding warrants.

The primary components of the system (10) consist of RF (Radio Frequency) tags (60), antennas and readers. The RF tag (60) in this embodiment is a passive tag which is preprogrammed with VIN (Vehicle Identification Number), license plate number, expiration date of the registration, inspection and license tag, and the collected information of the owner of the vehicle. The RF tag (60) can be mounted on the windshield, license plate frame, or the rooftop of a commercial or passenger vehicle.

The tag reader and antenna can be integrated into the patrol vehicle (20) or as a separate entity. If the tag reader is integrated into the patrol vehicle (20), it is a part of the laptop or control station in the patrol vehicle (20). If the tag reader and antenna are separate pieces the reader is part of the control station in the patrol vehicle (20) and the antenna is attached to a road sign, underpass or other stationary objects along a street or highway. When the tag reader and the antenna are separate the antenna communicates with the reader through an encrypted or encoded wireless network.

In the integrated embodiment the reader/antenna combination is mounted in the patrol vehicle (20) in the rear window, a side window, or on the trunk or hood of the car. The tag reader antenna combination will broadcast RF energy over a field classified as the Read Zone. The RF tag (60) on the passenger or commercial vehicle reflects a small portion of the RF energy back to the antenna. These reflected radio waves include the tag''s unique identification code and pre-stored information which includes the VIN, license plate and registration expiration date. The antenna relays a signal to the tag reader and adds information such as the date and time to the tag''s identification code, and stores it in a buffer. The tag reader then submits the vehicle information stored in the RF tag (60) to the patrol vehicle''s (20) laptop or control station, via a direct cable connection from the tag reader to the laptop or control station. Information from the vehicle is compared to a stored database on the laptop, and connected to the Network Server at the police station.

Alternately, there can be a Network Storage Device in the trunk of the patrol vehicle, which is connected to the laptop computer and holds the database information. The Network Storage device would hold a subset database from the Network server, which could easily be updated in real time by a wireless connection to the Network Server, or at the end of an officer''s shift. The subset database contains encoded criminal information including license plate numbers of stolen vehicles in the area, registration information, drivers with suspended licenses, convicted sex offender information, Be On the Lookout (BOLO), and outstanding warrants. The database would also contain fingerprint information on wanted criminals or missing persons. If there is a match between the vehicle''s RF tag (60) information and anything in the database the officer would hear an audible notice to follow the car and take appropriate action. If no match exists then the data is transferred to a network server for further analysis or storage. If after further analysis no match is found the information is deleted. If a match is found after further analysis the officer is audibly alerted with instructions on a course of action. The in vehicle analysis of the data will take only milliseconds to complete.

The tag readers operate on an international standard 915 MHz and 2450 MHz band with a possibility of a 5.8 GHz capability available in alternate embodiments. Properly displayed RF tags could be read at speeds in excess of 100 MPH at a distance of 100 feet, which allows an officer to use the system in a highway setting.

A suspect that comes into officer''s custody would not only submit identification information such as a driver''s license or passport, but also a fingerprint sample to confirm their identity. The fingerprints are collected by means of a PDA configured with a fingerprint sensor (USB, Compact Flash, Serial or PCMCIA) biometric capture software and short-range wireless hardware and software. The biometric software prompts the officer to have the suspect place his or her fingerprint on the sensor for collection, and to enter basic suspect information, including but not limited to name, address, driver''s license number and license plate number. The officer may enter the information via keystroke, free-hand or verbally. The biometric software then relays the information to the patrol vehicle''s laptop for analysis. The laptop relays back to the PDA the status of the analysis for the officer to take appropriate action.

If no laptop is available, the officer my choose to have the information relayed directly to other law enforcement agency databases for analysis including but not limited to Integrated Automated Fingerprint Identification System (IAFIS), Criminal Justice Information Services (CJIS), NCIC and Immigration and Naturalization Services database (IDENT). The communication between the laptop and the PDA utilizes the short-range wireless hardware and software. If no laptop is available, the PDA would communicate via cellular, 802.11, Satellite or other wireless media.

The PDA device communicates with the laptop in the patrol vehicle by sending and receiving the fingerprint information from the suspect. If the suspect has a criminal record or has fingerprints on file with law enforcement officials their true identity would be revealed and if there is a discrepancy that exists the officer can take appropriate action. If there is no fingerprint history and no further action is needed from the officer, the fingerprint information is discarded.

The system (10) functions by use of a tag system on a vehicle (40, 50), and a connection from the patrol car (20) to the network server (30). The patrol car (20) is set to scan moving vehicles (50) and parked vehicles (40) at all times. The vehicles (40, 50) have a tag in the interior of the vehicle and/or attached to the license plate. The patrol vehicle (20) scans the tag (not shown) and displays any pertinent information to the officer in the patrol car (20). The information can be displayed on the laptop or other applicable computer in the patrol car. The network server (30) relays information to the patrol car (20) including if the owner/passenger is a repeat offender of DUIs (Driving Under the Influence), if the owner/passenger is a registered sex offender, and if the owner/passenger has outstanding warrants for any offence. The officer can then act on the information accordingly.

The system (10) has two methods of detection that can be used by the officer: fixed point detection, and mobile detection. The fixed point detection includes a fixed antenna reader mounted on an underpass, or other applicable place along a highway or other road. The antenna will read the tag (not shown) on each passing car and relay any discrepancies to local patrol vehicles. The system (10) analyzes the tag (FIG. 2) and relays the VIN (vehicle identification number) registration and license plate information to the network server (30). If the VIN and license plate or registration do not match the network server (30) notifies local patrol vehicles (20) so proper action can be taken. Additionally, if the registered owner of the vehicle is a registered sex offender, a repeat offender, or has outstanding warrants, the patrol vehicle (20) is notified of the infractions by the network server (30).

Mobile detection allows the patrol vehicle (20) to scan all close vehicles. The VIN, license plate, and registration would be displayed on the patrol vehicle''s (20) laptop or other computer. The system (10) includes an audible alarm, which can alert the officer of any discrepancy in the data retrieved from the passing vehicles. Additionally, if the owner is a repeat offender, a registered sex offender, or has any outstanding warrants that information would be displayed as well. In this manner, the officer has as much information as possible to respond to the situation. As well as the patrol vehicles (20) the system (10) would provide scanners to all weigh stations to allow the Department of Motor Vehicles officers have appropriate information about the trucks passing over the scales.

Figure 2:
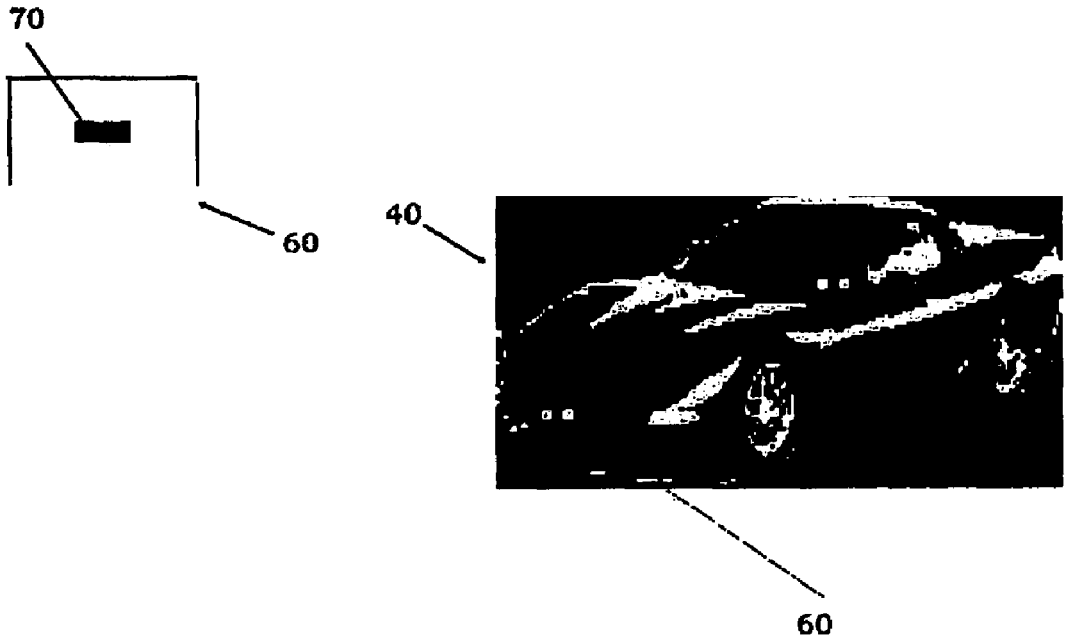
FIG. 2 shows an example of the transmitting tag as attached to a vehicle.

FIG. 2 shows a possible embodiment of the RF tag (60) as installed in a parked vehicle (40). The RF (Radio Frequency) tag (60) relays information about the vehicle (40) to a reader in the patrol vehicle (20) by use of a fixed antenna (not shown) or an antenna located in the patrol vehicle. The RF tag (60) is a self-adhesive sticker, which is mounted on the dash or the windshield, and on the front or back license plate holder. The RF tag (60) is approximately three inches high by approximately four and a half inches wide, and is transparent in nature. Future versions of the RF tag (60) will be incorporated into the vehicle (40) in the computerized functions of the dash. The RF tag (60) has a memory chip (70), which in the current embodiment holds 1024 bits of information. The memory chip (70) hold information on the vehicle (40) such as VIN (Vehicle Identification Number), License plate number, plate expiration date, drivers license number of the registered owner, state identification code, and driver restrictions. The RF tag (60) can be an active or passive tag, active tags are powered by the electrical system of the vehicle (40) or have an internal battery, and passive tags would only be activated by the reader in the patrol vehicle (FIG. 1, 20).

Figure 3:
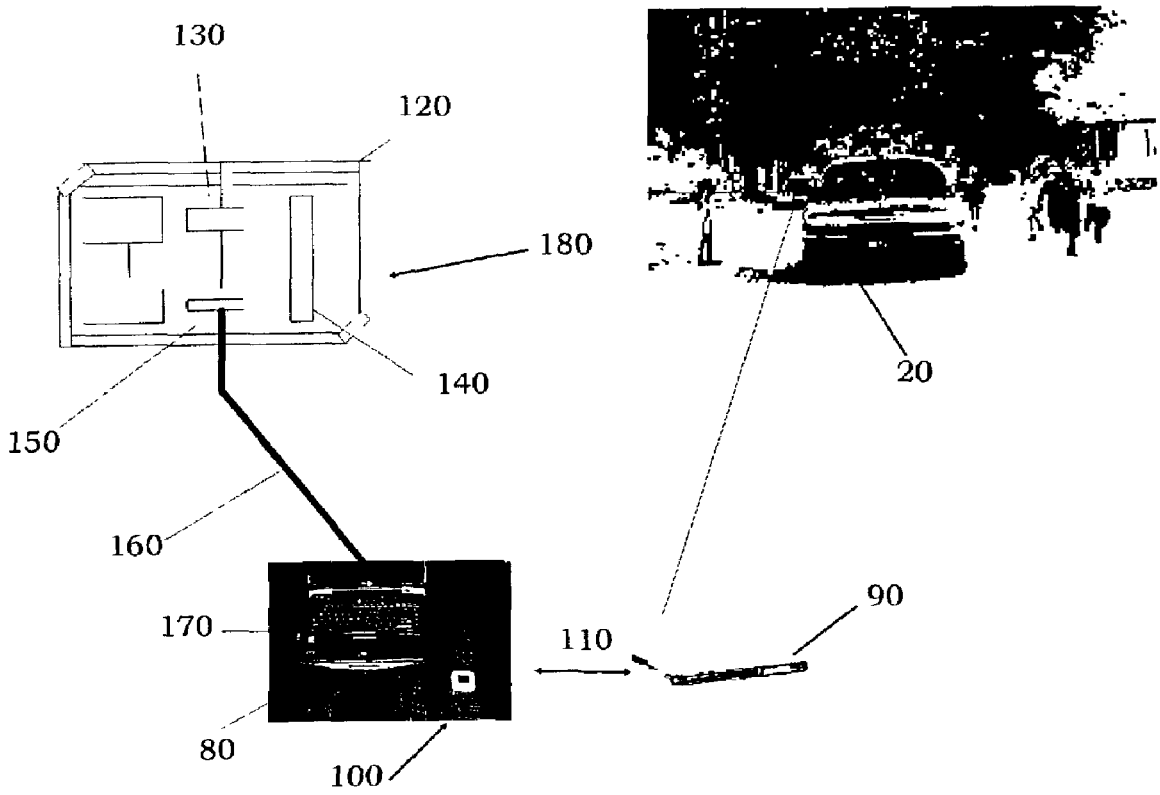
FIG. 3 shows a close up view of the tag reader in the patrol vehicle.

FIG. 3 shows a view of the patrol vehicle (20) with a close up view of the antenna and tag reader assembly (180) as attached to the patrol vehicle''s laptop (80). Also shown is the Network Attached Storage Unit (90), which could be located in the patrol vehicle (20) in the trunk or other applicable space. The laptop (80) is attached to the antenna and tag reader assembly (180), by a standard PC interface. The antenna (120) in this embodiment is connected to the tag reader PC card (140) but in other embodiments could be attached to an underpass or other stationary object as described previously. The antenna (120) simultaneously transmits a set radio frequency, by use of the RF antenna controller (130), over a read zone, and collects information from passing RF tags (FIG. 2, 60). The antenna (120) then transmits the collected data to the standard PC interface adapter (150), which then checks against the Network Attached Storage Unit (90) for matches. The Network Attached Storage Unit (90) holds a remote database of the local law enforcement''s "hotsheet" and the department of motor vehicle''s information, any fingerprint databases, and information on outstanding warrants. If a match is found, the Network Attached Storage Unit (90) send information via an Ethernet Interface (110), to the laptop (80) so the officer can take appropriate action.

The laptop (80) also has a wireless connection (170) to the main law enforcement databases. The wireless connection (170) to the law enforcement allows the user to transmit allows the officer to check against all law enforcement databases and gives a wider search than can be accessed through the Network Attached Storage Unit (90). The laptop (80) also has an attached In-vehicle fingerprint identification system (100). The in-vehicle fingerprint identification system (100) is also connected to the Network Attached Storage Unit (90) and the law enforcement databases through the laptop (80). The laptop (80) is attached to the antenna and tag reader assembly (180) by a standard PC interface cable (150) and is connected to a standard PC interface controller (150).

Figure 4:
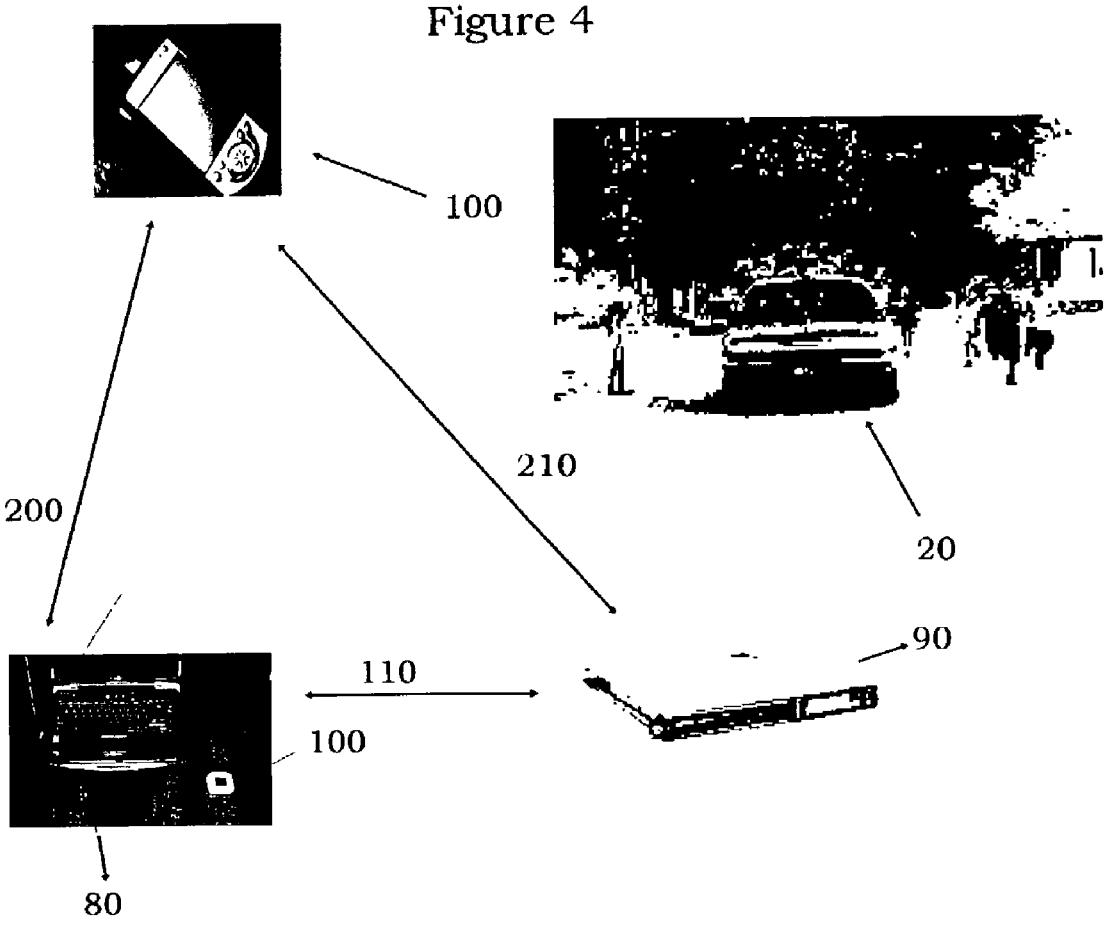
FIG. 4 shows a close up view of the fingerprint ID station wirelessly attached to the laptop.

FIG. 4 shows a close up view of the fingerprint identification system (100). The Fingerprint Identification system (100) is a PDA running on Window CE or other compatible system and is connected wirelessly to the lap top (80) and the Network Attached Storage Unit (90). The officer would carry the fingerprint identification system (100) to the suspect to capture a fingerprint. As long as the officer is within 300 feet of the patrol vehicle (20), the fingerprint is transferred to the laptop (80) and then checked against the database contained within the Network Attached Storage Unit (90), to determine if the identification information given by the suspect is correct and if the suspect has a previous criminal record, or any outstanding warrants.

Future embodiments of the present invention include the usage of mobile cellular phones equipped with cameras and fingerprint sensors which allow the officer to collect and verify the identity of an individual via electronic transmission of picture and fingerprint images.

The present invention is not limited to the sole embodiments described above, but encompasses any and all embodiments of the following claims.

The invention claimed is:

1. A system to assist law enforcement personnel, comprising:

a radio frequency tag, wherein said radio frequency tag is passive and does not require power, and wherein at least one said radio frequency tag is placed on a vehicle to be monitored;

an antenna to receive information, from 360 degrees, from all close vehicles, from said radio frequency tag that is capable of interrogation at speeds in excess of 75 mph;

a tag reader to translate said tag information from said antenna into a readable format; and a remote network database automatically, without user with system equipment installed in a law enforcement vehicle intervention, relays information matching the tag to said tag reader.

2. A system as in claim 1, wherein said radio frequency tag is attached to vehicles at the time of tag registration or sale.

3. A system, as in claim 2, wherein said radio frequency tag contains a data chip.

4. A system as in claim 3, wherein said data chip contains read only license tag information, the registered owner's contact information, including driver's license number and the make and model of the car; and wherein the read only license tag information, the registered owner's contact information, including driver's license number and the make and model of the car is not updated or altered during tag reader interrogation.

5. A system as in claim 4, wherein said antenna is attached to a stationary point on the highway such as an overpass bridge or an exit sign.

6. A system as in claim 5, wherein said tag reader is installed in a patrol vehicle.

7. A system as in claim 6, wherein said tag reader is further connected to a laptop system in the patrol vehicle.

8. A system as in claim 7, wherein data from said data chip in said tag reader is transferred via said antenna to said tag reader and said laptop to said remote network database.

9. A system as in claim 8, wherein said remote network database is linked to lists of outstanding warrants, registered sex offender lists, and expired registrations.

10. A system as in claim 8, further comprising a fingerprint identification system attached to said laptop.

11. A system as in claim 10, wherein said fingerprint identification system is attached to said remote network database through said laptop.

12. A system as in claim 11, wherein a fingerprint can be transferred from said fingerprint identification system through said laptop to said remote network database.

13. A system as in claim 12, wherein said remote database sends an matching fingerprint identification to said laptop.

14. A system to assist law enforcement professionals, comprising:

a passive radio frequency tag, attached to a vehicle;

an antenna to receive information, from 360 degrees; from said radio frequency tag, installed on stationary object on a highway or a bridge overpass;

a tag reader to receive said tag information from said antenna, installed in a patrol vehicle;

a laptop computer connected to said tag reader in a patrol vehicle;

a fingerprint identification system connected to said laptop computer; and a remote network database, automatically, without user with system equipment installed in a law enforcement vehicle intervention, communicating with said laptop computer, in real time, through existing law enforcement data communications infrastructure.

15. A system to assist law enforcement professionals, comprising:

at least one passive radio frequency tag, attached to a vehicle;

an antenna to receive information, from 360 degrees, from said radio frequency tag, installed on stationary object on a highway or a bridge overpass;

a tag reader to receive said tag information from said antenna, installed in a patrol vehicle;

a laptop computer connected to said tag reader in a patrol vehicle;

a fingerprint identification system holding at least two fingerprints of the driver, and connected to said laptop computer; and a remote network database, automatically, without user with system equipment installed in a law enforcement vehicle intervention, communicating in real time with said laptop computer through existing law enforcement data communications infrastructure.

16. A method to assist law enforcement professionals, comprising:

receiving information, from 360 degrees, from a radio frequency tag;

transferring the information automatically, without user with communications equipment installed in a law enforcement vehicle intervention, in real time, through existing law enforcement data communications infrastructure; and providing an alert after the information has been transferred.

* * * * *